US009297125B2

(12) United States Patent
Hammes et al.

(10) Patent No.: US 9,297,125 B2
(45) Date of Patent: Mar. 29, 2016

(54) CONSTRUCTION VEHICLE FOR PREPARATION OF A ROAD SURFACE

(71) Applicant: BOMAG GMBH, Boppard (DE)

(72) Inventors: Manfred Hammes, Emmelshausen (DE); Jens-Martin Zehbe, Schoningen (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 13/889,755

(22) Filed: May 8, 2013

(65) Prior Publication Data

US 2013/0300182 A1 Nov. 14, 2013

(30) Foreign Application Priority Data

May 10, 2012 (DE) ..... 10 2012 009 310

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/00* (2013.01)

(58) Field of Classification Search
CPC ..... E01C 23/127; E01C 2301/00
USPC ..... 299/39.1, 39.4, 39.5, 39.6, 39.7
See application file for complete search history.

(56) References Cited

U.S. PATENT DOCUMENTS 4,846,009 A * 7/1989 Paluska, Jr. ..... 74/331
5,890,392 A * 4/1999 Ludanek et al. ..... 74/331
5,893,677 A * 4/1999 Haehn et al. ..... 404/90
7,601,095 B2 * 10/2009 Hasegawa et al. ..... 477/180
8,465,105 B2 * 6/2013 Parker et al. ..... 299/39.4
2011/0290614 A1 12/2011 Mahlberg et al.
2012/0146389 A1 6/2012 Von Schonebeck et al.

FOREIGN PATENT DOCUMENTS

DE 10 2007 028 812 A1 12/2008
DE 20 2007 010 294 U1 1/2009
DE 10 2009 029 785 A1 12/2010

OTHER PUBLICATIONS

Espacenet, English Machine Translation of Application No. DE202007010294U1, published Nov. 27, 2008, retrieved from http://worldwide.espacenet.com on May 7, 2013 (11 pages).

Espacenet, English Machine Translation of Application No. DE102007028812A1, published Dec. 24, 2008, retrieved from http://worldwide.espacenet.com on May 7, 2013 (13 pages).

(Continued)

*Primary Examiner* — David Bagnell
*Assistant Examiner* — Michael Goodwin
(74) *Attorney, Agent, or Firm* — Wood, Herron & Evans, LLP

(57) ABSTRACT

The invention relates to a construction vehicle for preparation of a road surface, more particularly a road milling machine or a ground stabilizer, comprising a rotatably driven milling cutter, more particularly a milling rotor or a milling drum, and a drive unit for a milling tool, comprising a drive motor and a gear unit interposed between the drive motor and the milling cutter, wherein the gear unit is in the form of a cogwheel gearbox and comprises at least two gear pairings having different gear ratios, wherein the gear pairings can be selectively engaged to form part of the drive connection or disengaged therefrom.

7 Claims, 3 Drawing Sheets

(56) References Cited

OTHER PUBLICATIONS

Espacenet, English Machine Translation of Application No. DE102009029785A1, published Dec. 23, 2010, retrieved from http://worldwide.espacenet.com on May 7, 2013 (12 pages).

Steinbrecher, Michael, English Translation of Abstract for Application No. DE102009029785A1, published Dec. 23, 2010 (1 page).

German Patent Office, German Search Report for Application No. 10 2012 009 310.1, mailed Jan. 29, 2013 (4 pages).

* cited by examiner

CONSTRUCTION VEHICLE FOR PREPARATION OF A ROAD SURFACE

CROSS-REFERENCE TO RELATED APPLICATIONS

The present application claims priority under 35 U.S.C. §119 of German Patent Application No. 10 2012 009 310.1, filed May 10, 2012, the disclosure of which is hereby incorporated herein by reference in its entirety.

FIELD OF THE INVENTION

The present invention relates to a construction vehicle for preparation of a road surface, in particular, a road milling machine.

BACKGROUND OF THE INVENTION

An example of such a construction vehicle is disclosed in DE 20 2007 010 294 U1. The latter comprises a milling drum mounted on a vehicle frame and driven by a diesel engine. Disposed downstream of the diesel engine is a transmission for transferring the drive power to the milling drum and to other transmissions connected in parallel.

A fundamental problem with such construction vehicles relates to the extremely high degree of oscillation, vibration, or shaking which is generated by the milling tool and is referred to below in general as "vibration". This vibration can spread to substantially the entire construction vehicle unless damping measures are taken. Thus, individual measures aimed at decoupling individual vehicle components from the milling tool are always taken. For example, DE 10 2007 028 812 A1 concerns the decoupling of the driver's cab from the vibration generated by the milling tool.

The vibration produces a considerable amount of stress on the vehicle components. In order to ensure the durability of the drive motor, hitherto an attempt has always been made to decouple the drive motor as far as possible from the milling tool in terms of vibration. A currently widespread option is the use of a pump transfer gear, as described in the aforementioned document DE 20 2007 010 294 U1. The transmission of drive power between the drive motor and the milling tool is then achieved, at least partially, exclusively via the hydraulic pressure of a hydraulic fluid. The known damping properties of such a hydraulic fluid are then sufficient for adequately damping critical vibration.

The use of pump transfer gears is still widespread. This may be due to the fact that with such a pump transfer gear, a power take-off is easily engaged by operatively connecting other hydraulic motors. The disadvantages of such pump transfer gears, however, reside in the fact that their efficiency is somewhat poor as well as in the fact that fluid is lost resulting from leakages inherent to such a transfer gear. The leakages furthermore prevent precise speed synchronization between individual drives. Moreover, a pump transfer gear is expensive to purchase and maintain. Only pump transfer gears having a rigid gear ratio are acceptable in terms of purchasing and maintenance costs.

SUMMARY OF THE INVENTION

Thus the object of the present invention is to provide an improved construction vehicle of the aforementioned type and thus to reduce costs in terms of the drive connection and/or to reduce the aforementioned disadvantages of the prior solutions as far as possible.

One aspect of the present invention lies, in particular, in the use of a standard cogwheel gearbox by means of which the gear ratio between input and output can be varied. Furthermore, such a cogwheel gearbox readily permits the operative connection of auxiliary units. Especially when use is made of vibration damping means in the drive train, e.g., a belt drive interposed between the transmission and the milling tool, it is no longer absolutely necessary to use a pump transfer gear in order to ensure vibration decoupling between the milling tool and the drive motor. Such a cogwheel gearbox can be purchased and maintained at considerably lower expense than a pump transfer gear. In addition, the use of a cogwheel gearbox offers the advantages now described below.

Depending upon the gear selected, satisfactory to good speed variability of the milling drum along with very high efficiency of the completely mechanical drive are achieved. The possibility of operating the drive motor with optimized efficiency is, at comparably low purchasing and maintenance costs, to a large extent independent of the speed of the milling tool required for the operation. Compared with a fully variable drive, the cogwheel gearbox is considerably more economical to produce. The entirely discrete gear stages are admittedly valid arguments against the use of a cogwheel gearbox. Compared with earlier models, however, the improved milling tools available today permit operation within a certain speed range, such that this disadvantage no longer precludes the use of a cogwheel gearbox. Furthermore, the cogwheel gearbox also offers the possibility of readily engaging and/or disengaging power take-offs.

The speed of the milling tool can be varied quickly and conveniently, more particularly during operation and especially under load. To this end, the cogwheel gearbox may be provided with different gear stages between an input shaft and an output shaft, which can be selectively used for power transmission. A clutch associated with the respective gear can be used for engaging or disengaging a gear stage (gear pairing).

In one embodiment, a first clutch is associated with the first gear pairing and a second clutch is associated with the second gear pairing, wherein by engaging one of the two clutches, the respective associated gear pairing can be selectively engaged to form part of the drive connection or disengaged therefrom. In this case, for example, two gears of a gear pairing are always in mesh with each other. The effective engagement of this gear pairing in the drive train is then achieved by actuating the corresponding clutch, analogous to a dual clutch transmission as used in the automobile industry. The advantage of this resides in the fact that changing the gear ratio is possible without interrupting the drive power. This aspect of using a dual clutch transmission can of course also be applied in case of more than two gears, which is thus comprised by the present invention. The essential advantage of the present invention resides in the fact that this dual clutch transmission can be engaged and disengaged without interrupting the tractive power and therefore allows for particularly harmonic engagement and disengagement procedures. The basic principle of the dual clutch transmission can thus be summed up to the drive train having two sub-transmissions with two clutches which alternately provide for force transmission. If one clutch engages during working operation, the other clutch will open and vice versa.

The clutches associated with the respective gear pairings are preferably connected in parallel to each other. As intended, the drive connection between the drive motor and the output shaft of the transmission unit is then interrupted exclusively via these clutches. The advantage of such an arrangement is that the clutches required for engagement are essentially the same as those by means of which the drive connection can be fully interrupted. There is then no need for a separate "pre-clutch" between the drive motor and the transmission unit.

Alternatively, a gear stage can also be engaged by bringing the two gears of the respective gear stage into mesh with each other. However, this requires a brief interruption of the drive power, for instance via a clutch disposed upstream of the entire transmission. Changing the gear ratio, however, does involve an interruption of the drive power.

By selecting the right gear ratios, it is possible to ensure a nearly, or at least sufficiently, steady operation of the drive motor, thus operating the latter as far as possible in its optimum efficiency range.

BRIEF DESCRIPTION OF THE DRAWINGS

The present invention will be explained in more detail in an exemplary and non-restrictive manner, with reference to the figures, in which.

DETAILED DESCRIPTION OF THE INVENTION

Figure 1:
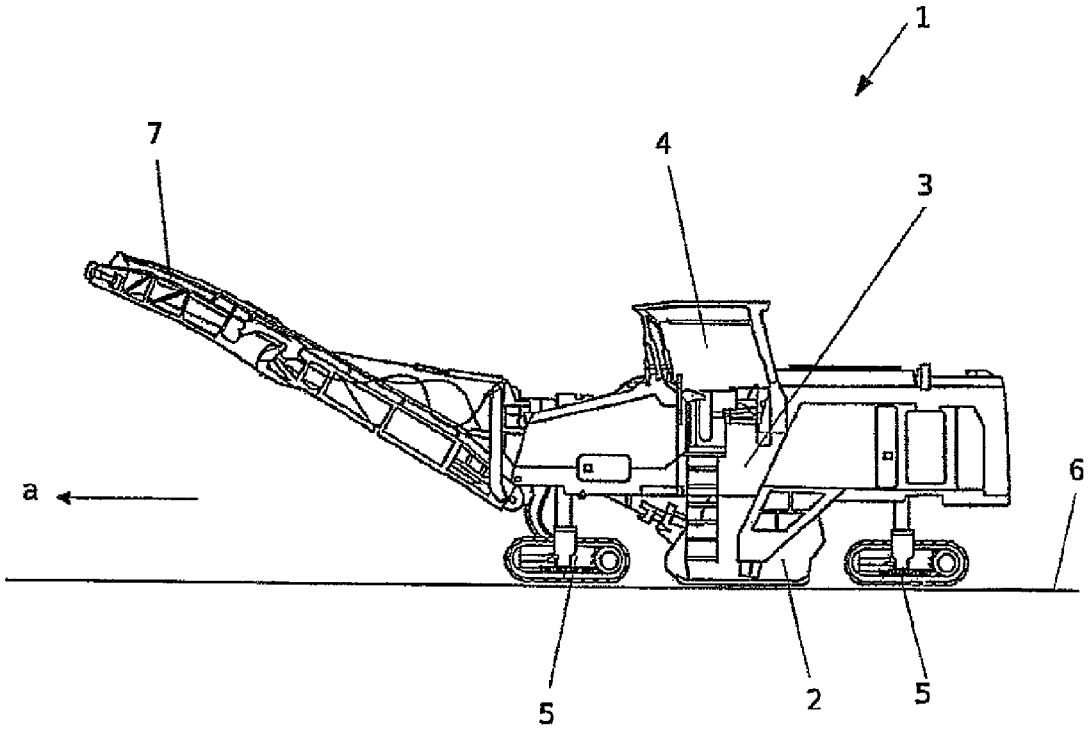
FIG. 1 is a diagram of a ground milling machine in its entirety.

FIG. 1 is a side view of a ground milling machine 1 (more specifically a front-end loader type road milling machine with a central rotor). The machine direction (forward direction) is indicated by the arrow "a". Essential elements of the ground milling machine include a milling device mounted in a drum housing 2, a vehicle frame 3 with a driver's station 4 and caterpillar tracks 5 mounted in a vertically adjustable manner on the vehicle frame 3 by means of lifting columns (alternatively, use can also be made of wheel driving units). The ground milling machine 1 further comprises a driving mechanism for a milling rotor, which will be explained in more detail below. The milling rotor driving mechanism is equipped with an internal combustion engine not indicated in any greater detail, by means of which the necessary mechanical working energy for operation is supplied. In the working mode, the ground milling machine 1 is driven over the road surface 6 in the machine direction "a" and grinds up road surface material with a milling rotor (not illustrated in FIG. 1) disposed within the drum housing 2.

FIGS. 2 to 5 illustrate the milling rotor driving mechanism diagrammatically. A diesel engine serves as a drive motor 11, the output shaft 16 of which is connected to an input shaft 17 of a cogwheel gearbox 12 for joint rotation therewith.

The drive torque is transferred via a pre-stage 20 to a first and second intermediate shaft 21*a*, 21*b*, in each case at the same gear ratio. A first multi-plate clutch 22*a* connects to the first intermediate shaft 21*a;* a second multi-plate clutch 22*b* connects to the second intermediate shaft 21*b*. The multi-plate clutches 22*a,* 22*b* are each used for engaging a first or a second gear stage 23*a*, 23*b* respectively. The two gear stages 23*a*, 23*b* each comprise an input pinion gear 24*a*, 24*b*, which are connected on the output side to the associated multi-plate clutch 22*a*, 22*b*. The two input pinion gears 24*a*, 24*b* mesh with output pinion gears 25*a*, 25*b*. The two gear stages 23*a*, 23*b* thus have different gear ratios. The two output pinion gears 25*a*, 25*b* are each fix-connected to an output shaft 26 of the cogwheel gearbox 12. The output shaft 26 in turn drives a belt drive 14, which finally drives the milling drum 15.

Furthermore, an auxiliary unit 28, for example, a generator or a hydraulic pump, is driven by the input shaft 17. To this end, the input shaft drives a pinion gear 27, which continuously meshes with another pinion gear 29, thereby continuously driving an auxiliary shaft 30. A cut-in clutch 31 for engaging the auxiliary unit 28 connects to this auxiliary shaft 30.

Figure 2:
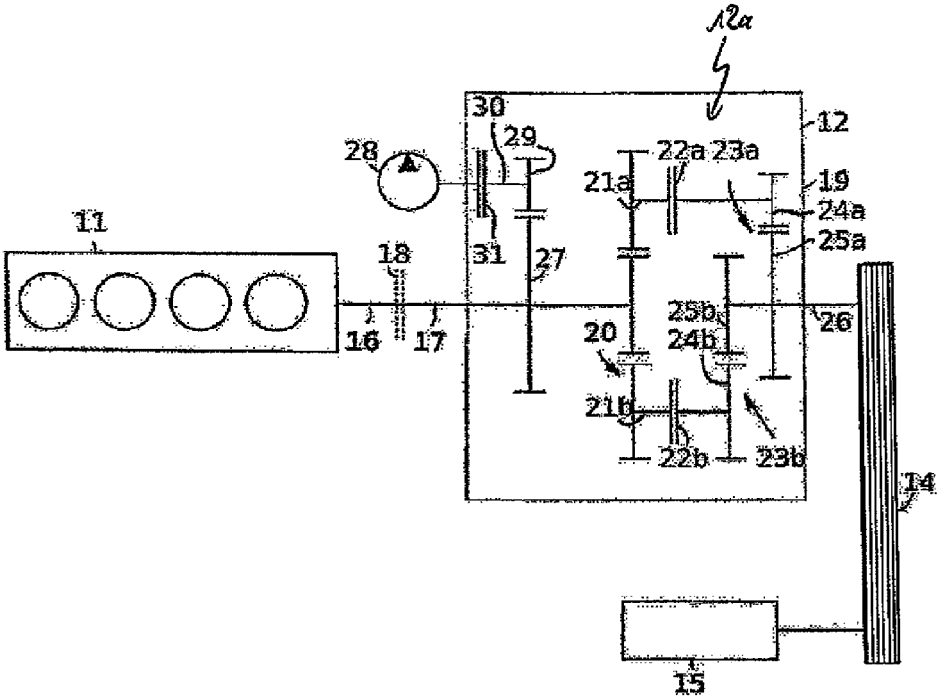
FIG. 2 is a diagram of a milling rotor driving mechanism comprising a main drive and a power take-off in neutral.

In the state illustrated in FIG. 2, the input shaft 17, the two intermediate shafts 21*a*, 21*b*, and the auxiliary shaft 30 are being driven. The input pinion gears 23*a*, 23*b* of the gear stages, however, are not being driven at this moment, since the multi-plate clutches 22*a* and 22*b* are disengaged. In order to drive the milling drum 15, one, and only one, of the gear stages 23*a*, 23*b* must be engaged in the drive train. To this end, only one of the two multi-plate clutches 22*a*, 22*b* is engaged. It can be seen that the gear ratio between the input shaft 17 and the output shaft 26 is established by selecting one of the multi-plate clutch elements 22*a*, 22*b* for engagement.

Figure 3:
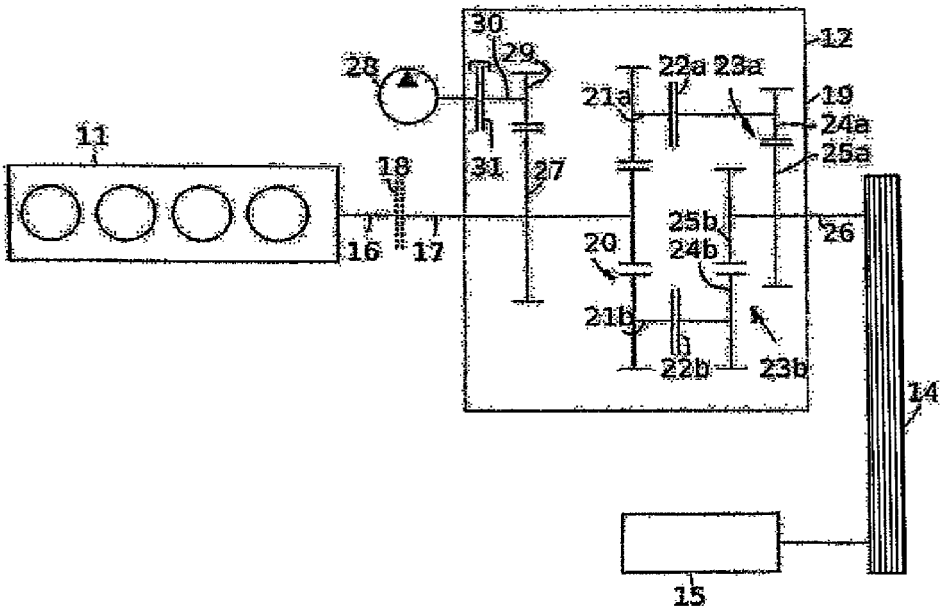
FIG. 3 is a diagram of the milling rotor driving mechanism as shown in FIG. 2 with the main drive in neutral and the power take-off engaged.

Unlike FIG. 2, FIG. 3 shows that the cut-in clutch 30 is now engaged. In this state, the milling drum 15 is not being driven, whereas the auxiliary unit 28 is.

Figure 4:
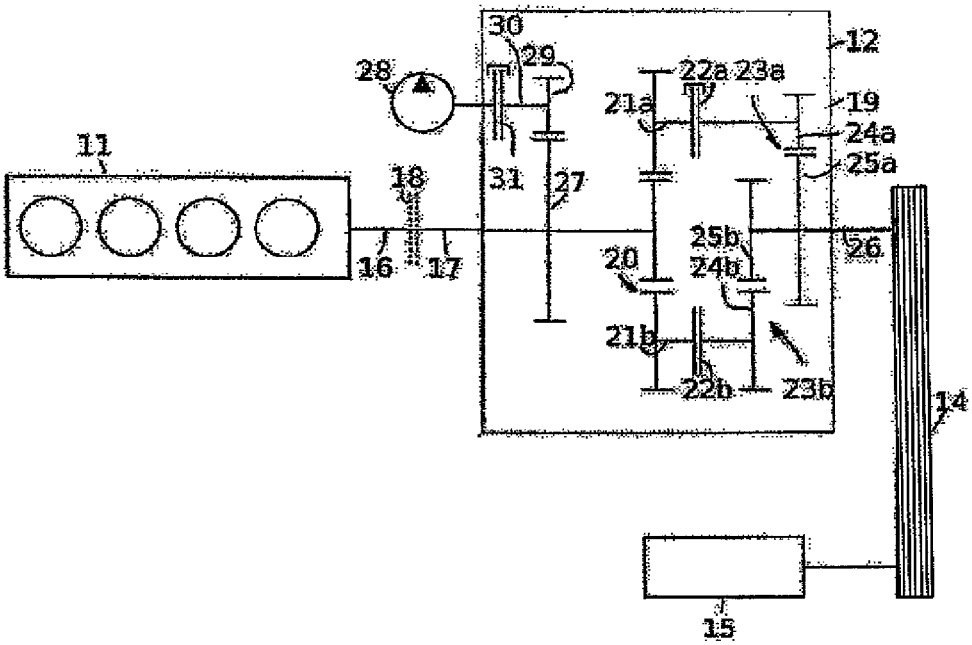
FIG. 4 is a diagram of the milling rotor driving mechanism as shown in FIG. 2 with the main drive engaged and the power take-off engaged in a first gear stage.

Unlike FIG. 3, FIG. 4 shows that the first multi-plate clutch 22*a* is now engaged, thereby establishing a drive connection between the diesel engine 11 and the milling drum 15. The first gear pairing of the input pinion gear 24*a* and the output pinion gear 25*a* of the first gear stage 23*a* are now part of the drive connection.

Figure 5:
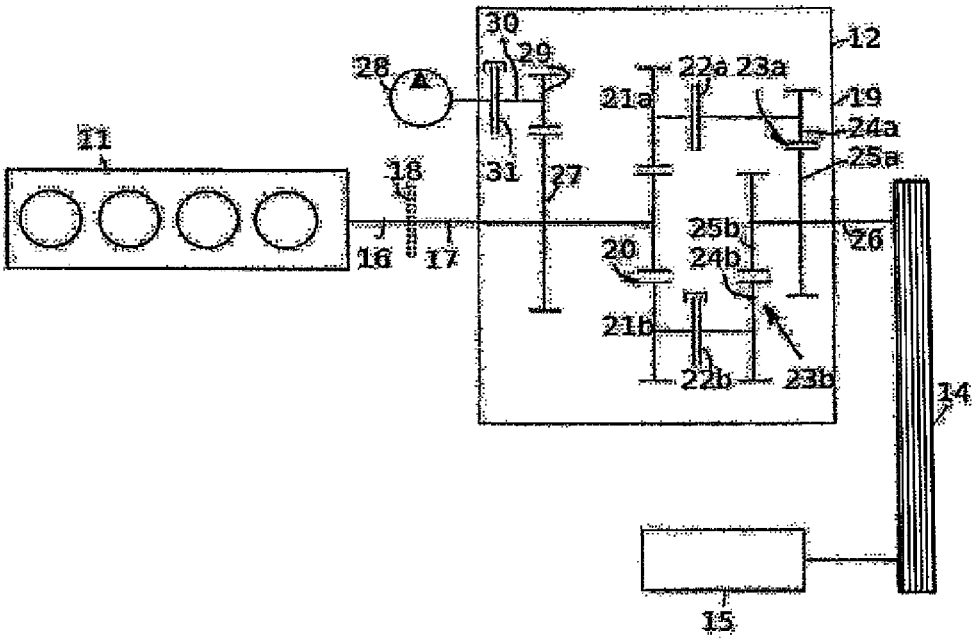
FIG. 5 is a diagram of the milling rotor driving mechanism as shown in FIG. 2 with the main drive engaged and the power take-off engaged in a second gear stage.

Unlike FIG. 4, FIG. 5 shows that the second multi-plate clutch 22*b* rather than the first multi-plate clutch 22*a* is engaged. Thus the drive connection between the diesel engine 11 and the milling drum 15 is still established, but with a different gear ratio. The second gear pairing of the input pinion gear 24*b* and the output pinion gear 25*b* of the second gear stage 23*b* are now part of the drive connection.

The drive connection between the output shaft 16 of the drive motor 11 and the output shaft 26 of the transmission 12 can be interrupted or established via the selectively engagable clutches 22. A shifting clutch between the drive motor 11 and the transmission 12, which is represented in the figures by dotted lines outside the transmission housing 19 and is designated by the reference numeral 18, is therefore unnecessary. Furthermore, this enables variation of the gear ratio without interrupting the traction force, so that an optimized gear ratio is provided depending on the application. Moreover, the number of gear pairings can be extended beyond the pairings indicated in the figures, so that the differences between the gear stages can be reduced, enabling optimized operation of the drive over a broad range of different rotational speeds of the milling drum.

Ideally, the multi-plate clutches 22*a*, 22*b* are connected functionally, for example, in such a manner that the clutches are prevented from both engaging simultaneously. Accordingly, the connection occurs in such a manner that only clutch 22*a*, or only clutch 22*b* respectively, is engaged while the respective other clutch is disengaged. This is achieved, in particular, by the configuration of dual clutch transmission 12*a*.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A road milling machine or a ground stabilizer, comprising:

a rotatably driven milling cutter; and a drive unit for said milling cutter comprising a drive motor and a gear unit interposed between said drive motor and said milling cutter, wherein said gear unit is in the form of a cogwheel gearbox and comprises at least two gear pairings having different gear ratios, wherein the at least two gear pairings can be optionally engaged to form part of a drive connection or disengaged therefrom with a first clutch being assigned to a first of the at least two gear pairings and a second clutch being assigned to a second of the at least two gear pairings, wherein the act of closing one of the at least two clutches causes the respectively assigned first or second gear pairing to be engaged to form part of the drive connection and the other one to be disengaged therefrom so that the speed of the milling cutter can be varied during operation and under load.

2. The road milling machine or ground stabilizer according to claim 1, wherein the drive unit comprises a dual clutch transmission.

3. The road milling machine or ground stabilizer according to claim 1, wherein the first and second clutches respectively assigned to said first and second gear pairings are connected in parallel and the drive connection between said drive motor and an output shaft of said gear unit can be interrupted exclusively via said first and second clutches.

4. The road milling machine or ground stabilizer according to claim 1, wherein a torsion vibration damper is disposed between said gear unit and said milling cutter.

5. The road milling machine or ground stabilizer of claim 4, wherein the vibration damper comprises a belt drive.

6. The road milling machine or ground stabilizer of claim 1, wherein the rotatably driven milling cutter comprises a milling rotor.

7. The road milling machine or ground stabilizer of claim 1, wherein the rotatably driven milling cutter comprises a milling drum.

* * * * *